US006845970B1

(12) United States Patent
Kenton

(10) Patent No.: US 6,845,970 B1
(45) Date of Patent: Jan. 25, 2005

(54) GATE SECTION AND BASE FOR A SAFETY RAIL SYSTEM

(76) Inventor: Gregory S. Kenton, 5964 Idlewood Rd., Mound, MN (US) 55364

( * ) Notice: Subject to any disclaimer, the term of this patent is extended or adjusted under 35 U.S.C. 154(b) by 72 days.

(21) Appl. No.: 10/319,992

(22) Filed: Dec. 16, 2002

Related U.S. Application Data

(63) Continuation-in-part of application No. 09/595,794, filed on Jun. 16, 2000, now Pat. No. 6,554,257.

(51) Int. Cl.[7] ..... E04H 17/00
(52) U.S. Cl. ..... 256/73
(58) Field of Search ..... 256/73, 1, 59, 256/67, 65.01, 65.02

(56) References Cited

U.S. PATENT DOCUMENTS 710,051 A * 9/1902 Fullam ..... 256/73 X
3,342,458 A * 9/1967 Simonton ..... 256/73 X
5,711,433 A * 1/1998 Smith ..... 256/73 X
6,039,308 A * 3/2000 Venegas, Jr. ..... 256/73

* cited by examiner

*Primary Examiner*—John Cottingham
(74) *Attorney, Agent, or Firm*—Hugh D. Jaeger

(57) ABSTRACT

An improved gate section and base for a portable safety rail system which utilizes cast iron bases and hinged gate sections. The improved base includes four post receivers, recessed handles with smooth edges, and stacking recesses. The improved gate section incorporates a single pull double latching mechanism which includes two durable and robust latches each with its own manual operating tab but also a manual operating handle whereby both latches can be operated simultaneously.

16 Claims, 17 Drawing Sheets

GATE SECTION AND BASE FOR A SAFETY RAIL SYSTEM

CROSS REFERENCES TO RELATED APPLICATIONS

This patent application is a continuation-in-part of Ser. No. 09/595,794 entitled "Safety Rail System" filed on Jun. 16, 2000, now U.S. Pat. No. 6,554,257.

BACKGROUND OF THE INVENTION

1. Field of the Invention

This invention pertains to a gate section and base for a safety rail system for providing a protective barrier for blocking access to a hazardous area or for preventing falls from an elevated area.

2. Description of the Prior Art

Prior art safety rail systems required the user to secure components of the systems by some type of securing method, such as by using anchor bolts or by welding pieces together. One similar prior art system to that disclosed herein utilizes cast iron bases and rail sections. That system uses two post receivers on each cast iron base to support only two rail sections. In each post receiver are four cast holes spaced 90 degrees from one another. These holes are used to secure the rail sections to the base with some type of securing pin. In contrast, the base constructed in accordance with the present invention includes four post receivers each having a plurality of slots instead of holes to provide for infinite positioning.

A common prior art system utilizes cast iron bases each of which has toe board receiver slots cast into the perimeter of the base itself, creating protrusions. These protrusions could extend up to six inches from the base surface. In contrast, the safety rail system disclosed herein uses removable toe board adapters. By utilizing the adapter method, it is unnecessary to provide protrusions on the base. Hence, the base of the present invention has no protrusions and, therefore, potential hazards due to protrusions extending upwardly from the base are eliminated. One hazard is a potential tip-over of a forklift driving over the protrusions. Another potential hazard is human injury should someone trip over the protrusions and fall. These protrusions also become a nuisance when toe boards are not in use.

Also, the prior art bases have cutouts creating handle formations for use in carrying the bases, but those handle formations are difficult to grasp and in addition have sharp corners or edges which make gripping uncomfortable. In contrast, the bases of the present invention have recessed handles with continuously curved or radiused edges which are devoid of sharp corners, thus making the handles easily accessible and comfortable to grip.

Further, prior art safety rail systems include gate sections which have only a single latch. Such gate sections lack stability. The present invention provides for a gate section for a safety rail system which includes plural latches for increasing the stability of the gate section.

SUMMARY OF THE INVENTION

The general purpose of the present invention is to provide an improved gate section and an improved cast iron base for a safety rail system which is intended to be used to cordon off work areas and the like where human safety is an issue. When the cast iron base is coupled to the rail and/or gate sections, it has enough weight, mass and strength to withstand tipping. Thus, the system provides a safe means of protection should one fall against it. It also meets and exceeds OSHA regulations for permanent safety railings. When used on an elevated work surface, optional toe board adapters are added. These adapters enable the system to be in accordance with OSHA regulations pertaining to elevated work areas.

The base is the vital component of the system and enables the system to be as versatile as it is described herein. The base according to this invention has four post receivers so as to enable as many as four rail sections, latching posts, or gate posts to be incorporated at any one time. Designed into each of the post receivers are strategically positioned slots. These slots will align with two vertically spaced holes in the vertical posts of the rail sections. This alignment will enable the rail sections to be secured to the base at infinite positions along a 360° rotation with some type of locking pin. Thus, the system has the versatility to have up to four quadrants of work areas to be defined by the base placement. The base also incorporates four symmetrically positioned holes to enable a permanent mount to a surface, via some form of anchor bolts, if desired.

Further, the base includes cutouts and recesses which form recessed handles for manual grasping when it is necessary to move or carry the base. All edges of the recesses and the upper edges of the cutouts are rounded to eliminate sharp corners that could prove to be uncomfortable when the recessed handles are gripped. Yet another feature of the base is a stacking feature. Specifically, the base includes stacking recesses on its planar bottom surface in alignment with the post receivers. These stacking recesses receive the upper ends of the post receivers for stacking of bases when not in use. Drain holes coaxial with the post receivers and the stacking recesses extend through the base.

The rail sections used in the safety rail system come in varying lengths and are comprised of iron tubing with a sufficient wall thickness to withstand the potential force that could be exerted when a person falls against a rail section. It is to be understood that aluminum or another appropriate material may be used in the rail section construction. The rail sections include a rail-locking system that adds additional strength to the entire system, preventing tipping. The vertical posts of each rail section have doughnut-shaped metal pieces (securing rings) welded at equal heights from the bottoms of the posts. The securing rings have precise internal cutouts that enable each rail section to be secured to each other with some type of securing means. A carabiner or locking safety chain would be sufficient to additionally secure the rail sections together. The internal cutouts enable the rail sections to be secured to one another at infinite directions of any rail section that is incorporated in the base at any one time.

This invention incorporates a derivative of the rail section. It is a gate section that is utilized to access a work area without having to remove locking pins and a rail section to gain access. A coupler is designed to attach and lock a gate post to a base post receiver. This feature is important so it can lock the angle of assembly of the gate post to the base. Without the coupler, the gate post would move within the post receiver slots and then would not align with the gate latching post after moving from its original installation position.

The gate section of this invention includes a single pull double latching mechanism which provides excellent stability to the gate section, thus enabling the gate section to withstand the same type of forces which the rail sections can withstand. The single pull double latching mechanism includes two durable and robust latches each with its own manual operating tab but also with a mutual operating handle whereby both latches can be operated simultaneously.

The safety rail system also comes with an optional number of horizontal cross members or vertical posts that can be welded to the rail sections. This feature enables this portable system to be used in a variety of markets. One example of this feature is the agricultural market. One could specify the requirements of spacing between the horizontal/vertical spacing of the cross members so that animals could not escape from a livestock pen created using the safety rail system.

Also included in the invention is a support wheel for additional support of the gate during pivoted or static states.

Having thus described embodiments and significant aspects and features of the present invention, it is the principal object of the present invention to provide a gate section and base for a safety rail system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
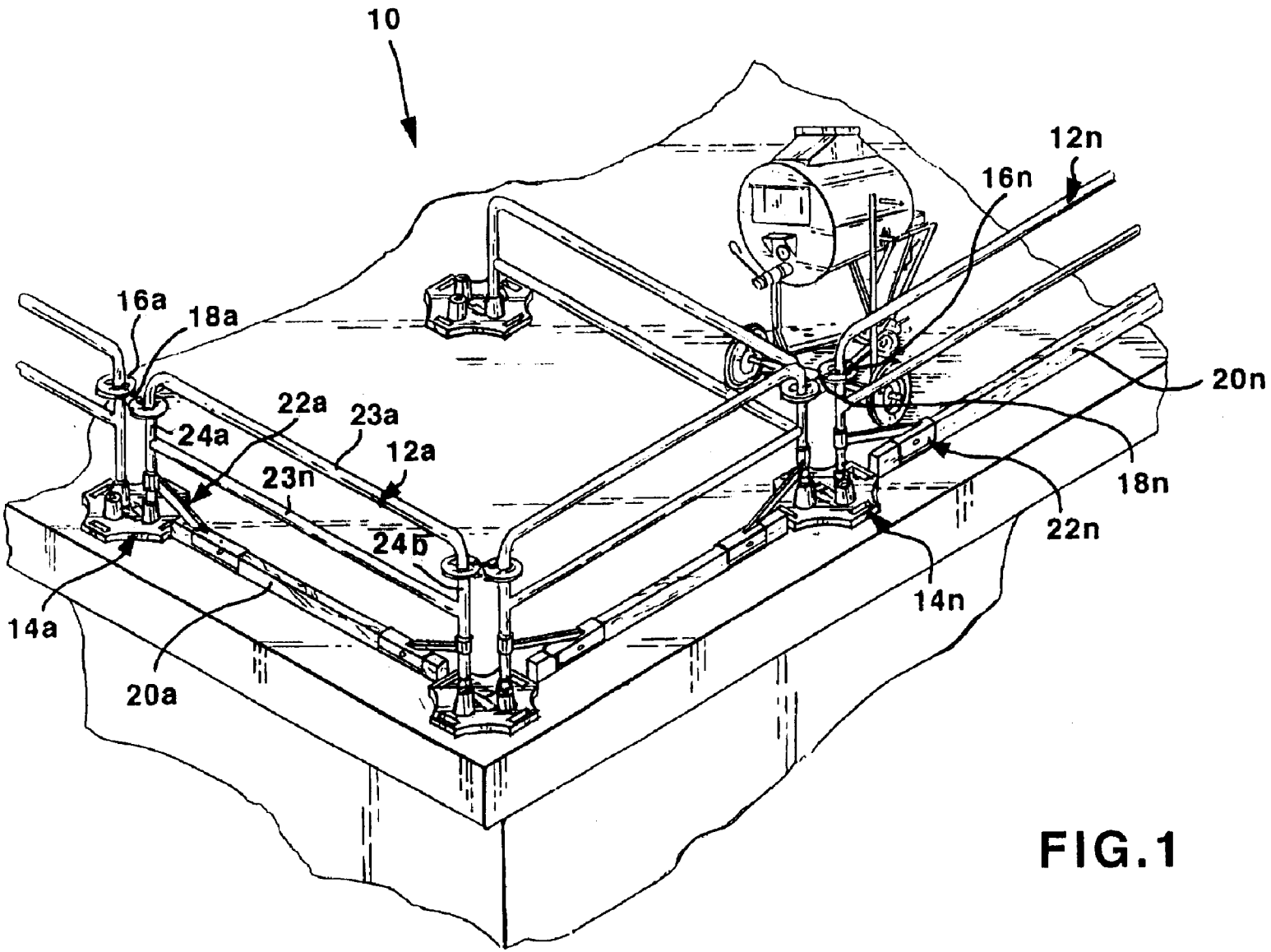
FIG. 1 illustrates a perspective view of a safety rail system.

FIG. 1 illustrates a perspective view of a safety rail system 10. This illustration shows the safety rail system 10 assembled on a rooftop in a random configuration. The safety rail system 10 is comprised of a plurality of rail sections 12*a*–12*n*, a plurality of bases 14*a*–14*n*, a plurality of rail lock donuts 16*a*–16*n*, a plurality of securing chains 18*a*–18*n*, and a plurality of toe boards 20*a*–20*n* used in conjunction with a plurality of toe board receivers 22*a*–22*n*. Each component will be later described in detail with reference to the following figures.

Figure 2:
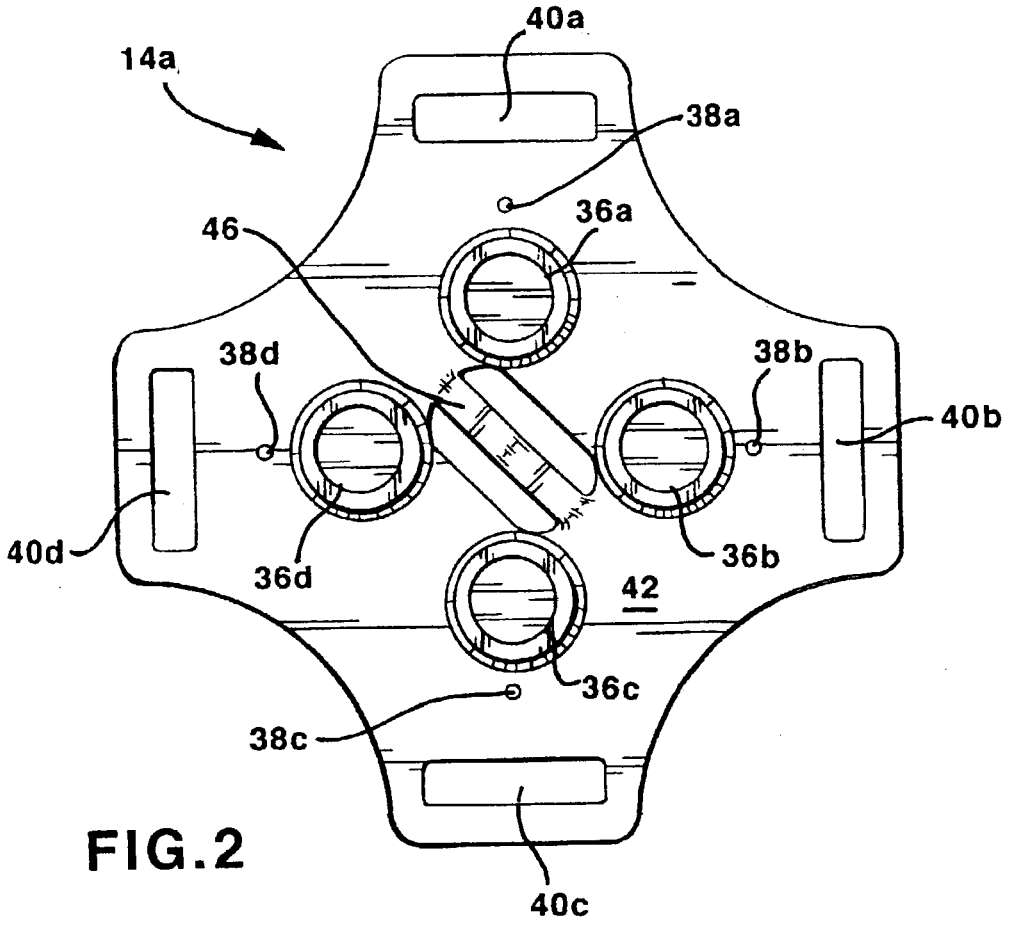
FIG. 2 illustrates a top view of a base.
Figure 3:
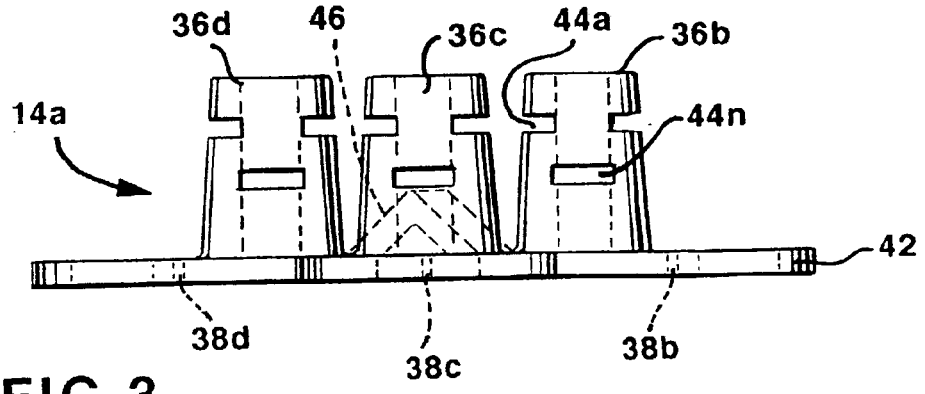
FIG. 3 illustrates a side view of the base.
Figure 4:
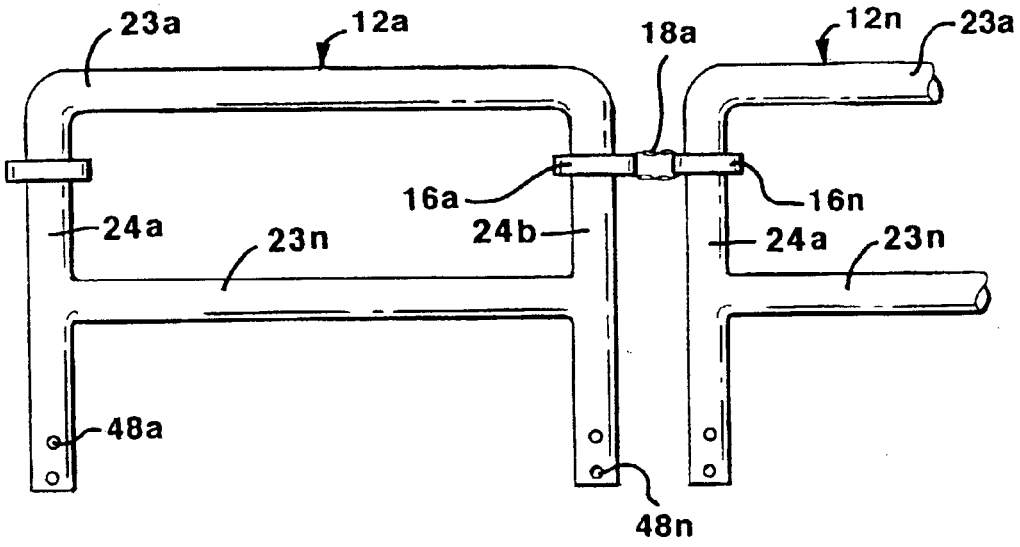
FIG. 4 illustrates a front view of two rail sections connected together using rail lock donuts and a securing chain.

FIG. 2 illustrates a top view of a base 14*a*, and FIG. 3 illustrates a side view of base 14*a*. The bases 14*a*–14*n* weigh between 100–120 lbs. and are cast iron or welded plate and tube to support rail sections 12*a*–12*n* without tipping. Each base 14*a*–14*n* is constructed in the same manner having identical parts including a planar portion 42 with cutouts 40*a*–40*d* on four opposing sides creating built-in handles for transporting it. There is also a centrally located lifting bar 46 which allows the user to hook the bases 14*a*–14*n* to a pulley or a dolly to more easily move the heavy bases 14*a*–14*n*. There are provided holes 38*a*–38*d* which accommodate anchor bolts for securing the bases 14*a*–14*n* to a work surface such as a concrete floor or roof top if permanent mounting is desired. The key feature of the bases 14*a*–14*n* is four post receivers 36*a*–36*d* which extend perpendicularly upward from planar portion 42. Rail sections 12*a*–12*n* are identical and each includes any number of horizontal rails 23*a*–23*n* connected at their ends to vertical posts 24*a*–24*b*. The vertical posts 24*a*–24*b* are positioned in the post receivers 36*a*–36*n* allowing the rail sections 12*a*–12*n* to be positioned in any position in a 360° range. Each of these post receivers 36*a*–36*d* includes a plurality of slots 44*a*–44*n*; and the vertical posts 24*a*–24*b* of the rail sections 12*a*–12*n* incorporate a plurality of corresponding holes 48*a*–48*n*, as shown in FIG. 4, for receiving locking pins 30 (FIG. 9) to hold the rail sections 12*a*–12*n* in place in the bases 14*a*–14*n* once the desired position is acquired. Once the rail sections 12*a*–12*n* are secured to bases 14*a*–14*n* at each end, the slots will allow the rail sections 12*a*–12*n* to pivot. Each base 14*a*–14*n* may accommodate a maximum of four rail sections 12*a*–12*n* which can be locked in any position within their range of motion. It is to be understood that the slots 44*a*–44*n* may be substituted with multiple holes at different heights, but holes will not allow the infinite 360° range at which the rail sections 12*a*–12*n* may be locked. The post receivers 36*a*–36*d* can also accommodate a latching post and/or a gate post which will be described with reference to FIGS. 4 and 5.

Figure 5:
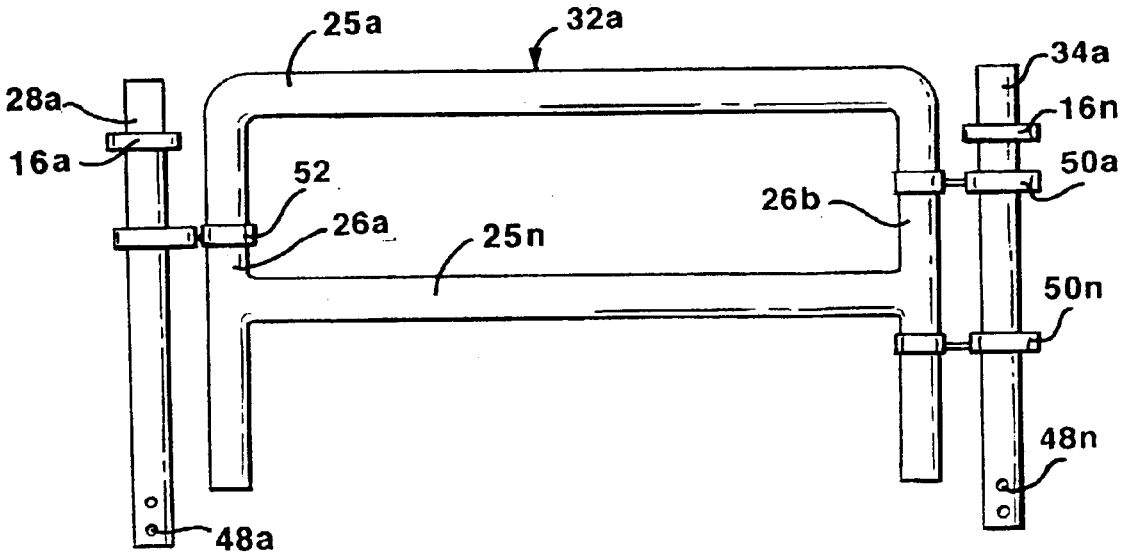
FIG. 5 illustrates a front view of a gate assembly including a gate section in conjunction with a latching post and a gate post.

FIG. 4 illustrates a front view of two rail sections 12*a*–12*n* connected together using rail lock donuts 16*a*–16*n* and a securing chain 18*a*, and FIG. 5 illustrates a front view of a gate assembly which includes a gate section 32*a* in conjunction with a latching post 28*a* and a gate post 34*a*. Each gate section 32*a*–32*n* includes any number of horizontal rails 25*a*–25*n* connected at their ends to vertical posts 26*a*–26*b*. A plurality of latching posts 28*a*–28*n* and a plurality of gate posts 34*a*–34*n* may be used in any configuration. Illustrated in these figures are the holes 48*a*–48*n* which were mentioned in connection with the previous figures. The latching post 28*a* and the gate post 34*a* also incorporate holes 48*a*–48*n* identical to those in the vertical posts 24*a*–24*b* of the rail sections 12*a*–12*n* and these holes serve the same purpose. Also illustrated are hinges 50*a*–50*n* which are secured to the gate post 34*a* in at least two positions. The opposite ends of hinges 50*a*–50*n* secure to the vertical post 26*b* of gate section 32*a*, creating a pivoting gate. The gate section 32*a* also has a gate latch 52 secured on the vertical post 26*a* opposite hinges 50*a*–50*n*. The gate latch 52 provides a locking means for the gate section 32*a*. In the configuration illustrated in FIG. 5, only the gate post 34*a* and the latching post 28*a* are secured to bases 14*a*–14*n* (not illustrated) and gate section 32*a* is suspended between them, creating the operational gate. Both the latching post 28*a* and the gate post 34*a* are locked in position using a locking coupler 54 which will be described with reference to FIGS. 6 and 7. It is necessary to lock the gate post 34*a* in position using the locking coupler 54 to prevent pivoting, keeping hinges 50*a*–50*n* in position.

Figure 6:
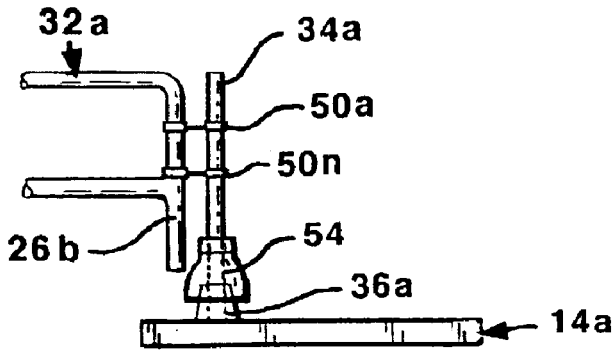
FIG. 6 illustrates a front view of a gate post and gate section where a locking coupler secures the gate post to a post receiver of a base.
Figure 7:
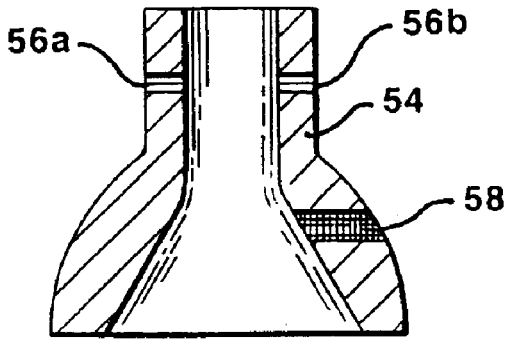
FIG. 7 illustrates a cross sectional view of the locking coupler.

FIG. 6 illustrates a front view of a gate post 34*a* and gate section 32*a* where locking coupler 54 secures gate post 34*a* to post receiver 36*a* of base 14*a*, and FIG. 7 illustrates a cross sectional view of locking coupler 54. Illustrated in particular is the configuration of the safety rail system 10 components when a gate is needed and the locking coupler 54 is used. Also illustrated are a set of holes 56*a* and 56*b* which lock the gate post 34*a* to the locking coupler 54 and a hole 58 which allows the locking coupler 54 to be secured to post receiver 36*a* of base 14*a* by a securing knob, bolt or other suitable device.

Figure 8:
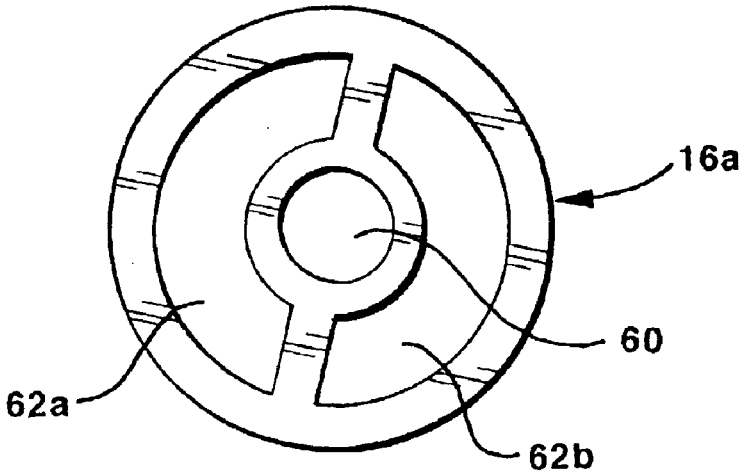
FIG. 8 illustrates a top view of a rail lock donut.

FIG. 8 illustrates a top view of a rail lock donut 16*a*. Illustrated in particular is a hole 60 whereby the rail lock donut 16*a* is secured to vertical post 24*a* or 24*b* of rail section 12*a*, and slots 62*a*–62*b* which accommodate securing chains 18*a*–18*n*, as illustrated in FIGS. 1 and 4.

Figure 9:
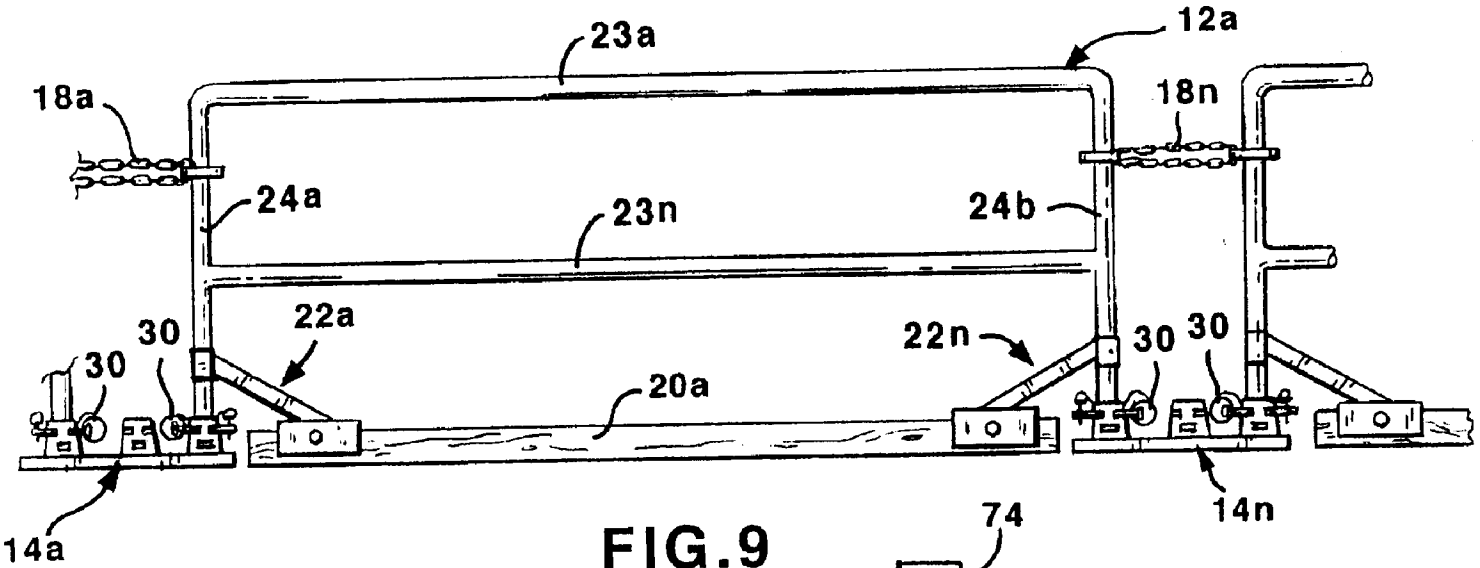
FIG. 9 illustrates a front view of a rail section supported by two bases and incorporating a toe board secured in place by toe board receivers.
Figure 11:
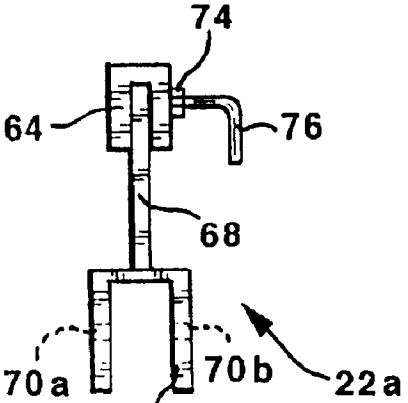
FIG. 11 illustrates a side view of a toe board receiver.
Figure 10:
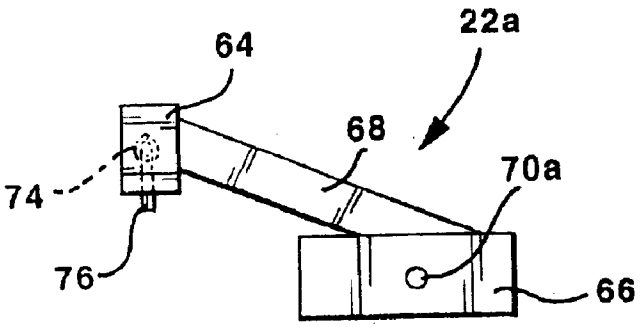
FIG. 10 illustrates a front view of a toe board receiver.

FIG. 9 illustrates a front view of a rail section 12*a* supported by two bases 14*a*–14*n* and incorporating a toe board 20*a* secured in place by toe board receivers 22*a*–22*n*. With further reference to FIGS. 10 and 11, the use of the toe board will now be described in detail.

FIG. 10 illustrates a front view of a toe board receiver 22*a*, and FIG. 11 illustrates a side view of a toe board receiver 22*a*. Each toe board receiver 22*a*–22*n* includes a sleeve 64 which is slid upwardly over and about the bottom of vertical post 24*a* or 24*b* of rail section 12*a* prior to securing rail section 12*a* to base 14*a*. Each sleeve 64 has a nut 74 welded to the outside over a hole, not illustrated, in the sleeve 64, where an L-bolt 76 or the like is screwed through the sleeve 64 and frictionally engages vertical post 24*a* or 24*b*. The sleeve 64 may also be bolted or welded, if necessary or so desired. There is a board receiver bracket 66 connected at an angle to the sleeve 64 by shaft 68. The board receiver bracket 66 is straddled over toe board 20*a* and appropriately secured thereto through holes 70*a* and 70*b* by a bolt, securing pin or other appropriate means. Each rail section 12*a*–12*n* should include two toe board receivers 22*a*–22*n* and one toe board 20*a*–20*n*, as illustrated, to prevent materials from being kicked off an elevated work area using the safety rail system 10.

Figure 12:
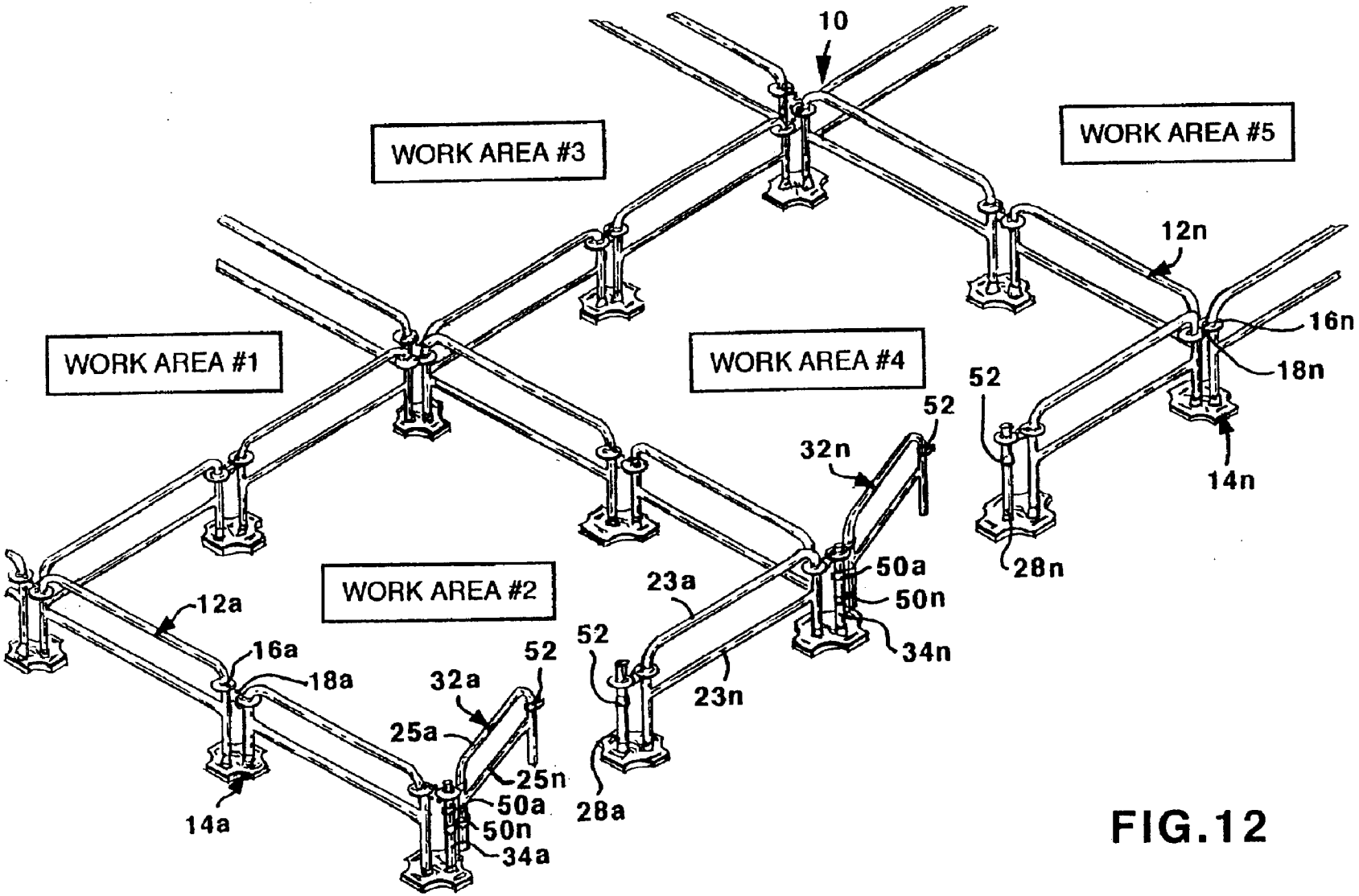
FIG. 12 illustrates a perspective view of the safety rail system configured for use in a manufacturing facility.

FIG. 12 illustrates a perspective view of the safety rail system 10 configured for use in a manufacturing facility. It defines the use for the four post receivers 36*a*–36*d* that are incorporated into the bases 14*a*–14*n*. Unlimited work areas can be defined with this set-up or one similar to it. Also illustrated is how the gate sections 32*a*–32*n* are used in conjunction with the rail sections 12*a*–12*n*. These gate sections 32*a*–32*n* allow access to the work areas by workers or a forklift, for example. When the gate sections 32*a*–32*n* are not in use, they are closed. When closed, these gate sections 32*a*–32*n* create a safe barrier just as the solid rail sections 12*a*–12*n* would. This illustration shows work areas configured in squares, but it is to be understood that the safety rail system 10 can be configured in any shape needed.

Figure 13:
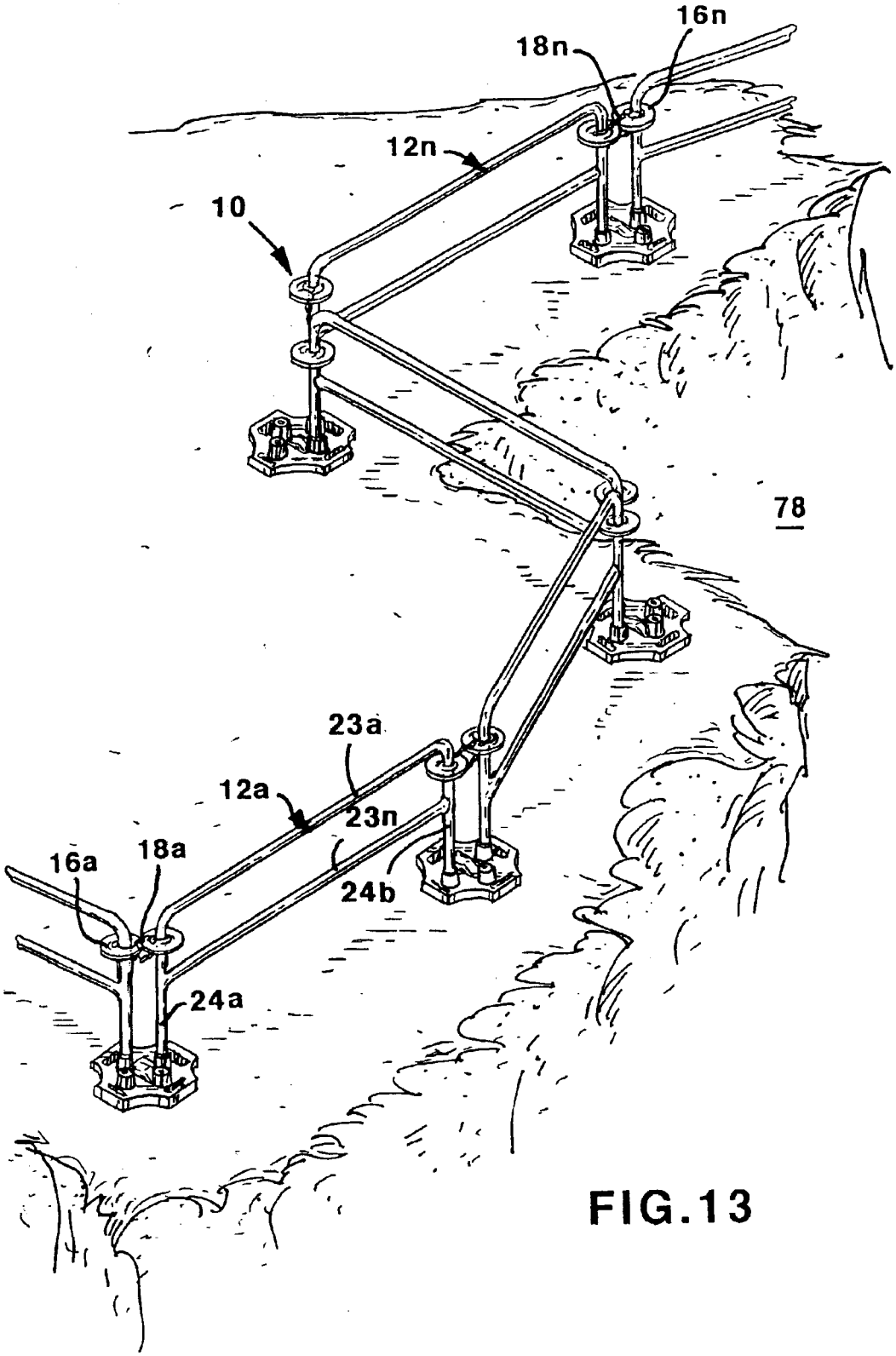
FIG. 13 illustrates a perspective view of the safety rail system constructed around a construction dig site.

FIG. 13 illustrates a perspective view of the safety rail system 10 constructed around a construction dig site 78. This configuration allows the safety rail system 10 to follow the various angles that are created by the edge of the dig site 78 and still be secured in position by the locking pins 30 (FIG. 9) at any of the angles shown, as well as an infinite number of angles not shown.

Figure 14:
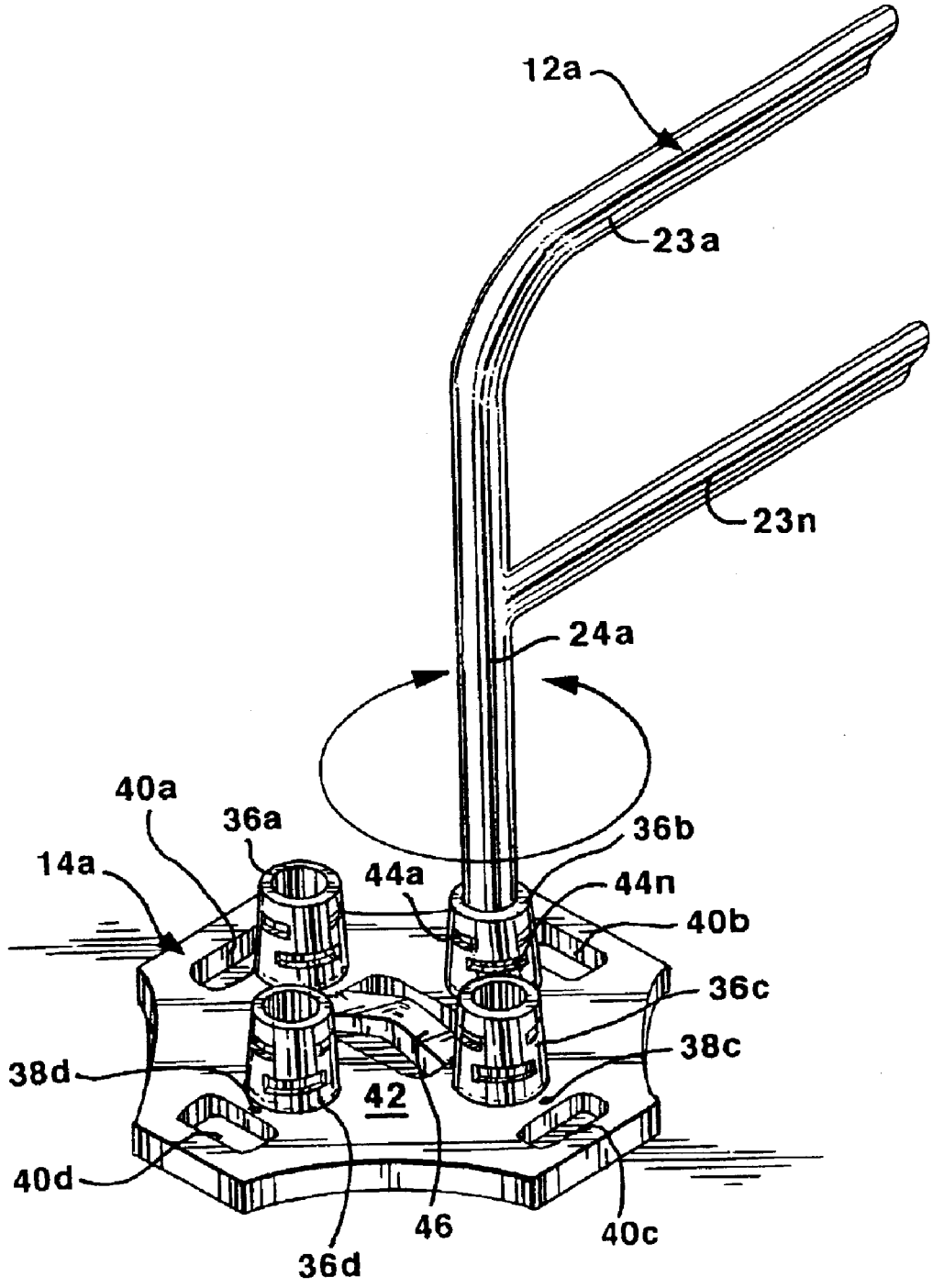
FIG. 14 illustrates a perspective view of a base and rail section depicting how each post receiver has a 360° rotation capacity.

FIG. 14 illustrates a perspective view of a base 14*a* and rail section 12*a* depicting how each post receiver 36*a*–36*d* has the capability to be secured by a locking pin 30 (FIG. 9) to a rail section 12*a*–12*d* in a 360° range when utilizing the slots 44*a*–44*n* in the post receivers 36*a*–36*d*. A plurality of holes at different horizontal planes may be substituted for the plurality of slots 44*a*–44*n*, but the holes would limit the direction the rail sections 12*a*–12*n* could be positioned and not allow the infinite positioning that slots 44*a*–44*n* provide.

Mode of Operation

With reference to FIGS. 1–14, the mode of operation is now described. The portable safety rail system 10 is comprised of a number of components. The rail sections 12*a*–12*n* come in varying lengths. Secured to the vertical posts 24*a*–24*b* of a rail section 12*a* is a rail lock donut 16*a*–16*n*. These rail lock donuts 16*a*–16*n* are secured at equal heights on all rail sections 12*a*–12*n* by welding or other appropriate means. When the rail sections 12*a*–12*n* are secured in position and the rail lock donuts 16*a*–16*n* are coupled with a securing chain 18*a*–18*n*, added strength is given to the system should a rail section 12*a*–12*n* start to tip over. A carabiner or other suitable device may be substituted for the securing chains 18*a*–18*n*. The tipped-over rail section 12*a*–12*n* would then try to drag the next attached rail section 12*a*–12*n* with it and so on. The overall weight will prevent the safety rail system from tipping over. The rail lock donut 16*a*–16*n* is designed so it too can accommodate the infinite directions available to the rail sections 12*a*–12*n* as they are turned in the post receivers 36*a*–36*d* of bases 14*a*–14*n*.

The gate assemblies for the safety rail system 10 are unique in design. A gate assembly is comprised of four major components: namely, one of the gate sections 32*a*–32*n*, one of the latching posts 28*a*–28*n*, one of the gate posts 34*a*–34*n*, and a locking coupler 54. The latching post 28*a* is where a gate latch 52 will secure the gate section 32*a* so to not swing to and fro. The gate section 32*a* connects via hinges 50*a*–50*n* to the gate post 34*a*. The gate sections 32*a*–32*n* also have the capability to have infinite positions for placement and when the desired direction is found, the locking couplers 54 can easily lock the gate sections 32*a*–32*n* into position so they will not move. The locking coupler 54 is made of a lightweight metal such as aluminum. It is machined halfway through to be the outside diameter of a gate post 34*a*–34*n*. The locking coupler 54 has holes 56*a*–56*b* for a securing means such as a spring pin or bolt that can be installed on the gate post 34*a*–34*n* so that the gate post 34*a*–34*n* cannot be removed. The lower interior of the locking coupler 54 is machined tapered to fit the tapered post receiver 36*a*–36*d*, or if tubing is used, it would not need to be tapered. It also has a hole 58 so that a knob can be screwed into the hole and against the post receiver so that the gate post 34*a*–34*n* will not rotate when mounted into position.

Although the safety rail system was designed for manufacturing facilities, construction sites, and animal pens, it can be used on elevated work surfaces and meets or exceeds OSHA s regulations for fall protection on an elevated work surface. The safety rail system has optional toe board receivers 22*a*–22*n* which are slid over and about the bottoms of each of the vertical posts 24*a*–24*b* of the rail sections 12*a*–12*n*. A toe board 20*a*–20*n*, that meets OSHA standards, can be secured to the board receiver bracket 66 and secured with a screw, bolt or locking pin. Once in place, the toe board receiver 22*a*–22*n* can be secured to the rail section by tightening the L-bolt 76 against the post receivers 36*a*–36*d* of bases 14*a*–14*n*. This device was also designed to have infinite directional movement before securement. No matter what position the base 14*a*–14*n* is in when the rail section 12*a*–12*n* is installed and secured, the toe board receivers 22*a*–22*n* will always be able to follow the run of the rail sections 12*a*–12*n*.

The bases 14*a*–14*n* are of a cast iron design or welded design to meet the weight requirements. They have enough weight that when varying lengths of rail sections 12*a*–12*n* or gate sections 32*a*–32*n* are secured to the post receivers 36*a*–36*d*, the safety rail system 10 can withstand a minimum of 250 pounds of pressure from any angle. This feature allows the system to be in compliance with OSHA Fall Protection Regulations. Each of the bases 14*a*–14*n* has four post receivers 36*a*–36*d* which allow the bases 14*a*–14*n* to accommodate as many rail sections 12*a*–12*n*, thus creating a maximum of four quadrants emanating from each base 14*a*–14*n*. The post receivers 36*a*–36*d* have strategically positioned slots 44*a*–44*n* that enable the rail section 12*a*–12*n* to be positioned in infinite directions while setting up another base 14*a*–14*n* at the end of the rail section 12*a*–12*n*. When the rail section 12*a*–12*n* is placed into the desired position, bolts or locking pins 30 are installed through the slots 44*a*–44*n*, into the holes 48*a*–48*n* on the vertical posts 24*a*–24*b* of rail sections 12*a*–12*n*. One type of locking pin is a clevis pin with a hole at one end for a lynch pin with a ball detent. A double ring with a lanyard can connect between a top of the clevis pin and the lynch pin for operator convenience. This secures the rail sections 12*a*–12*n* in place.

Figure 15:
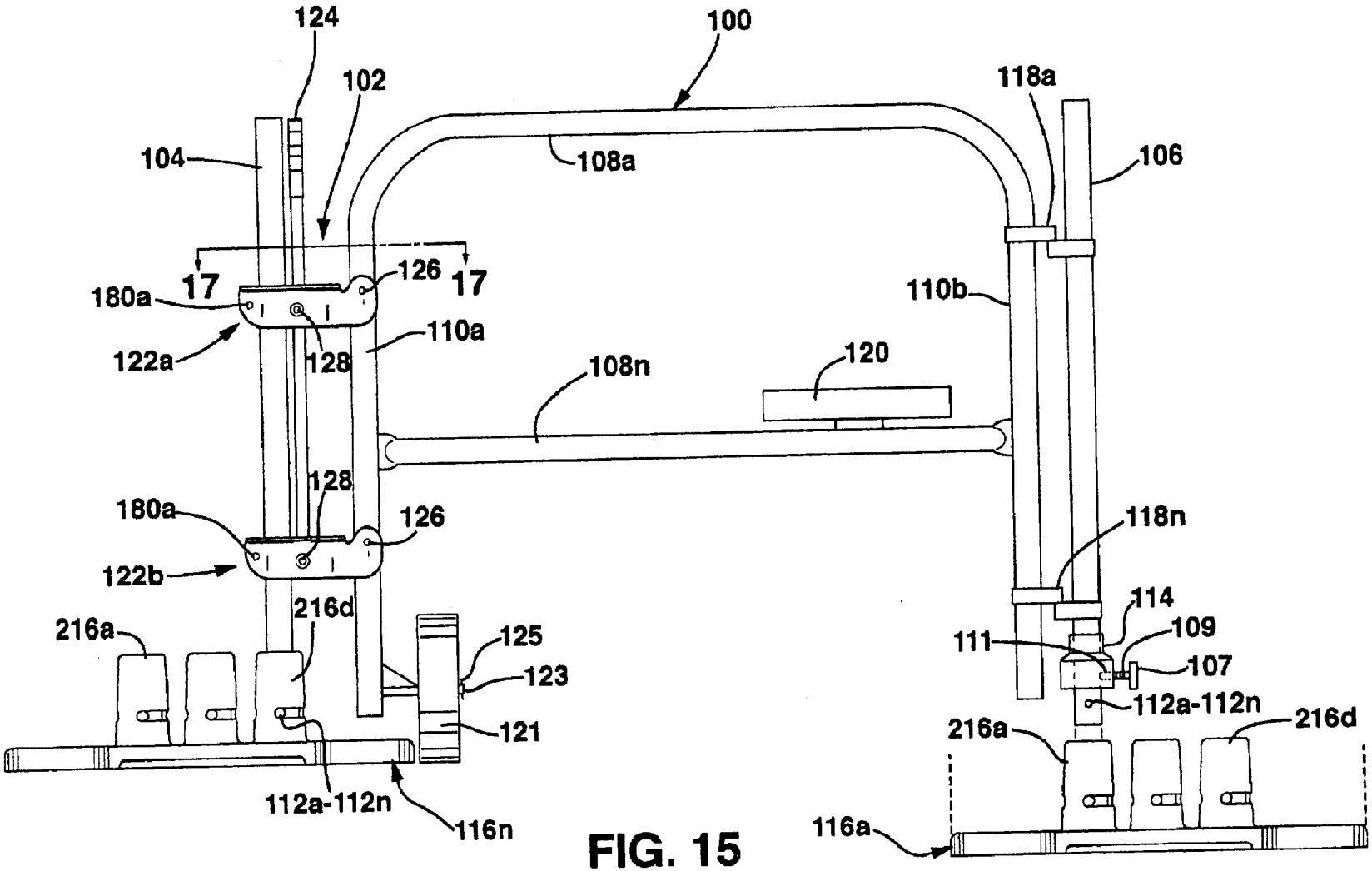
FIG. 15 is a front view of an alternative gate assembly featuring a gate section according to the present invention having a single pull double latching mechanism shown in conjunction with a gate post and a latching post.
Figure 16:
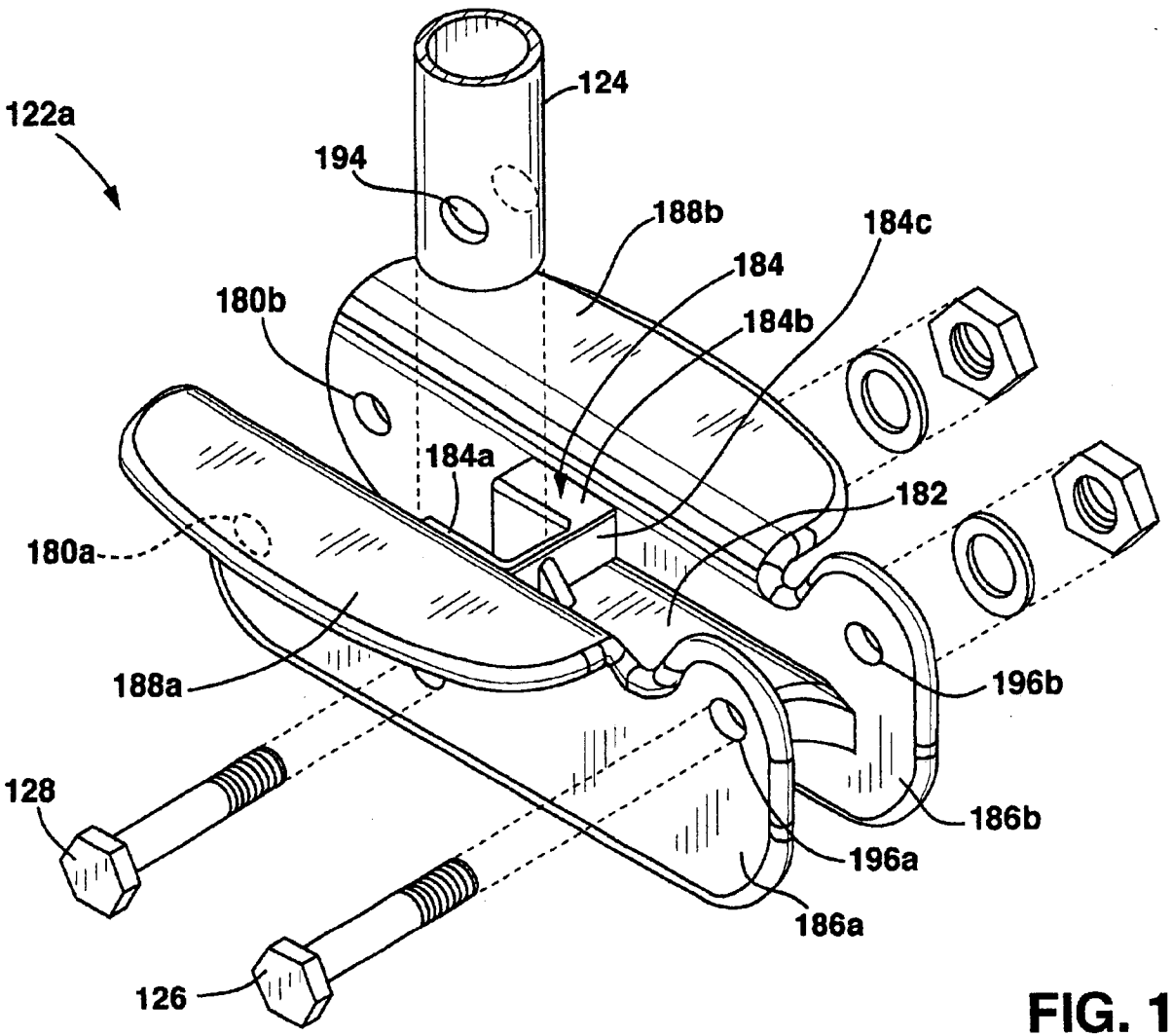
FIG. 16 is an isometric view of a latch.

FIG. 15 illustrates a front view of an alternative gate assembly featuring a gate section 100 according to the present invention having a single pull double latching mechanism 102 shown in conjunction with a latching post 104 and a gate post 106 for use with the safety rail system 10 and for use with the components and assemblies which are later described herein in detail. The gate section 100 includes any number of horizontal rails 108*a*–108*n* connected at their ends to vertical posts 110*a*–110*b*. A plurality of latching posts 104 and a plurality of gate posts 106, being substantially identical in use and geometric configuration to the latching posts 28*a*–28*n* and gate posts 34*a*–34*n*, may be used in any configuration. Both the latching post 104 and the gate post 106 incorporate holes 112*a*–112*n* somewhat identical to those lower holes of holes 48*a*–48*n* in the vertical posts 24*a*–24*b* of the rail sections 12*a*–12*n* and to the lower of the holes 48*a*–48*n* in the latching posts 28*a*–28*n* and the gate posts 34*a*–34*n*, and these holes serve the same purpose where locking pins can be received. The holes 112*a*–112*n*, for purposes of example and illustration, can be located with 90° spacing and at a common level. A locking coupler 114 similar in function and design to locking coupler 54 is incorporated at and suitably secured to the lower region of the gate post 106 for rotation-free coupling of the gate post 106 to one of a plurality of the post receivers 216*a*–216*d* extending upwardly from bases 116*a*–116*n* in the same manner as previously described with respect to the coupling of gate posts 34*a*–34*n* to the post receivers 36*a*–36*d* of the bases 14*a*–14*n*. A T-knob friction lock 107 having a threaded shaft 109 engages a threaded hole 111 in the side of the locking coupler 114 and is advanced to frictionally engage the gate post 106 to prevent inadvertent rotation of the gate post 106 with respect to the post receiver 216*a*. Such attachment provides for positional fixation of the gate post 106, thereby ensuring alignment and stability of hinges 118*a*–118*n* which are secured to the gate post 106 of at least two locations. The opposite ends of the hinges 118*a*–118*n* secure to the vertical post 110*b* of the gate section 100, thus creating a pivoting gate. The single pull double latching mechanism 102 of the gate section 100 secures on the vertical post 110*a* opposite hinges 118*a*–118*n* to provide a multi-level locking means for the gate section 100. A safety instruction container 120 is conveniently located on the horizontal rail 108*n* of the gate section 100. In the configuration illustrated in FIG. 15, the gate post 106 and the latching post 104 are shown being secured to the bases 116*a*–116*n*. The single pull double latching mechanism 102, the hinges 118*a*–118*n*, and the suspended gate section 100 and associated components are located between the gate post 106 and the latching post 104. The single pull double latching mechanism 102 is provided to promote stability of the gate section 100 between the gate post 106 and the latching post 104, especially at the latch post 104. Such stability is enhanced by having coupling of the gate section 100 along and about the latching post 104 by multiple latches instead of only a single latch. Traditional gates have three-point coupling involving two hinges and one latch. Incorporation of the single pull double latching mechanism 102 provides another point of coupling to offer four-point coupling including two hinges and two latches. The single pull double latching mechanism 102 includes pivotally attached identically constructed upper and lower latches 122*a* and 122*b*, respectively, suitably spaced and located along and about vertical post 110*a*, each having one end pivotally attached to the vertical post 110*a* by a pivot assembly 126 such as a nut and bolt assembly or other suitable pivot assembly. An operating handle 124, operating as a linkage, extends through and pivotally connects to the upper and lower latches 122*a* and 122*b* using centrally located pivot assemblies 128 such as nut and bolt assemblies or other suitable pivot assemblies. The ends of the upper and lower latches 122*a* and 122*b* opposite the pivot assemblies 126 are of open structure, as shown in FIG. 16, to allow capture of the latching post 104 and include opposing lock holes 180*a* and 180*b*, as best shown in FIG. 16. Upward actuation of the operating handle 124 causes simultaneous operation of upper and lower latches 122*a* and 122*b* about the respective pivot assemblies 126 to disengage the upper and lower latches 122*a* and 122*b* from intimate communication and contact with the latching post 104, thereby allowing the gate section 100 and the single pull double latching mechanism 102 to be swung open about the hinges 118*a*–118*n* to allow access therethrough. A support wheel 121 attaches to the lower region of the vertical post 110*a* via a supported axle 123 and suitable securing device such as, but not limited to, a cotter pin 125 to provide additional support for the gate 100 during static or pivotal states.

FIG. 16 is an isometric view of the upper latch 122*a*, such latch being identical to lower latch 122*b*. The upper latch 122*a* is preferably of lightweight cast aluminum material but can be of other material, or can be fabricated of separate pieces as desired. The upper latch 122*a* includes a central support member 182 and a connected adjacent receptacle bracket 184 having two opposing sides 184*a* and 184*b* and a third side 184*c* (FIG. 17) located at and extending between mirror image like planar sides 186*a* and 186*b*. The receptacle bracket 184 accommodates the shaft of the operating handle 124, the lower portion of which is shown. Manual operating tabs 188*a* and 188*b* extend substantially at a right angle from the upper regions of the planar sides 186*a* and 186*b*. A hole 190*a* and a hole 190*b* (FIG. 17) extend through the receptacle bracket sides 184*a* and 184*b*, the planar sides 186*a* and 186*b*, and the bosses 192*a* and 192*b* (FIGS. 18 and 19), respectively, to accommodate pivot assembly 128. Sets of opposing holes 194 are located at levels along the operating handle 124 to accommodate the pivot assemblies 128 which secure the upper and lower latches 122*a* and 122*b* to the operating handle 124 in conjunction with holes 190*a*–190*b*. Also shown in FIG. 16 are holes 196*a* and 196*b* extending through one end of the planar sides 186*a* and 186*b* for accommodation of the pivot assembly 126 which pivotally attaches the latch 122*a* to the vertical post 110*a*. The ends of the upper and lower latches 122*a* and 122*b* opposite the pivot assemblies 126 are of an open three-sided capturing structure for capture of the latching post 104, as shown in FIG. 17.

Figure 17:
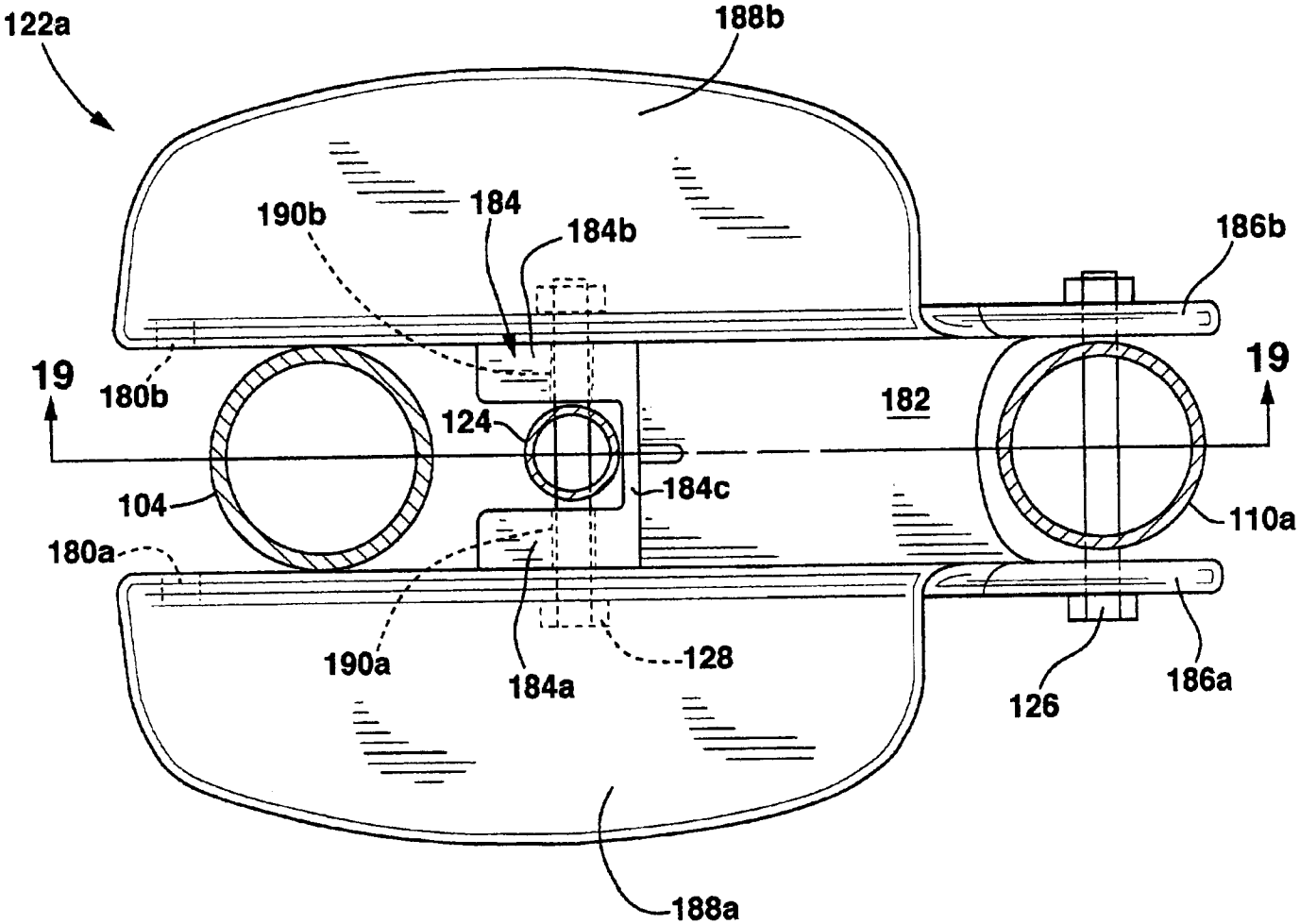
FIG. 17 is a top view of the latch with the latching post, the operating handle, and a vertical post shown in cross section as taken along line 17—17 of FIG. 15.

FIG. 17 is a top view of the upper latch 122*a* with the latching post 104, the operating handle 124, and the vertical post 110*a* shown in cross section as taken along line 17—17 of FIG. 15. This figure illustrates the capturing of the latching post 104 as typified by the upper latch 122*a*.

Figure 18:
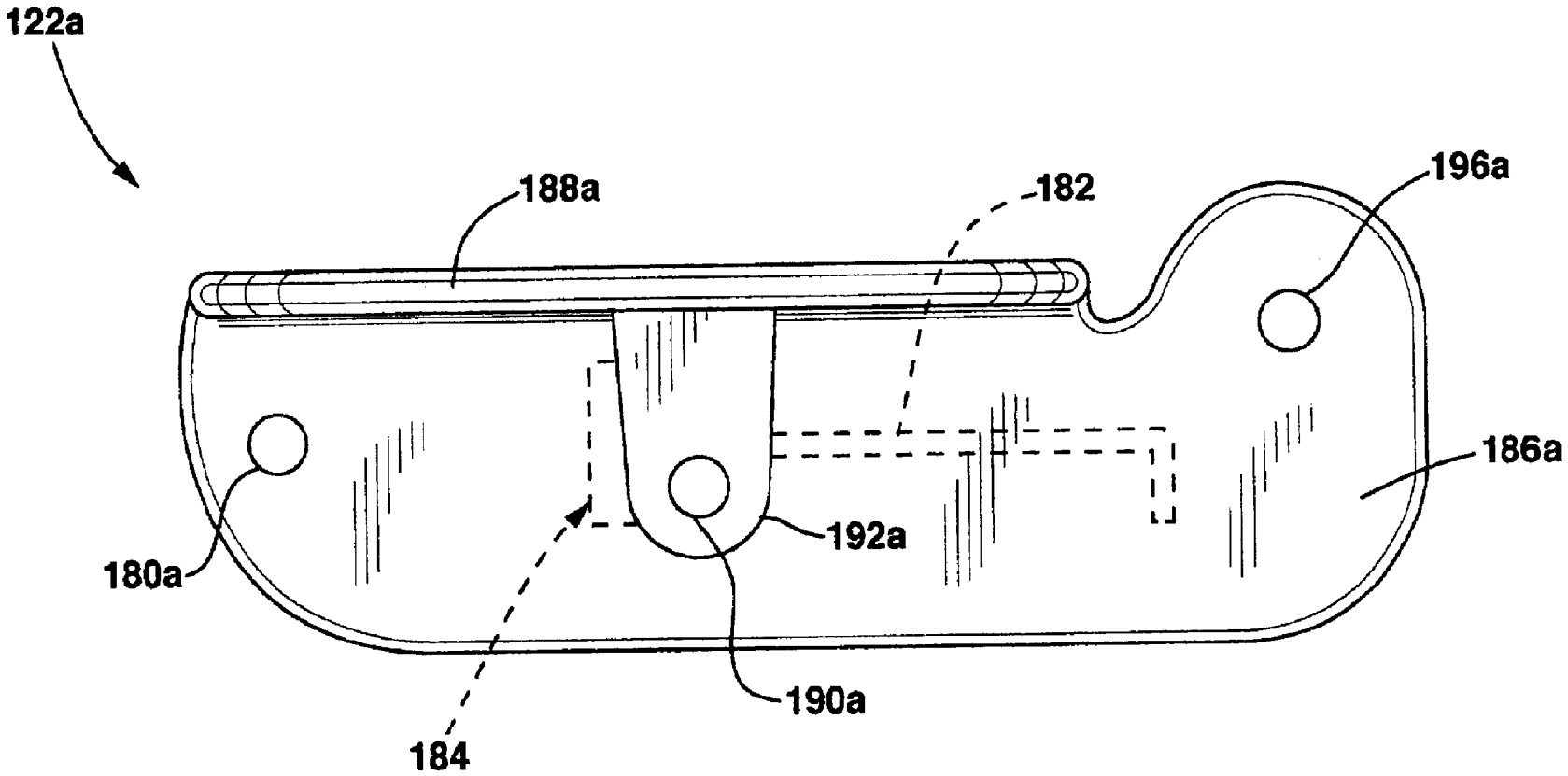
FIG. 18 is a side view of the latch.

FIG. 18 is a side view of the upper latch 122*a*.

Figure 19:
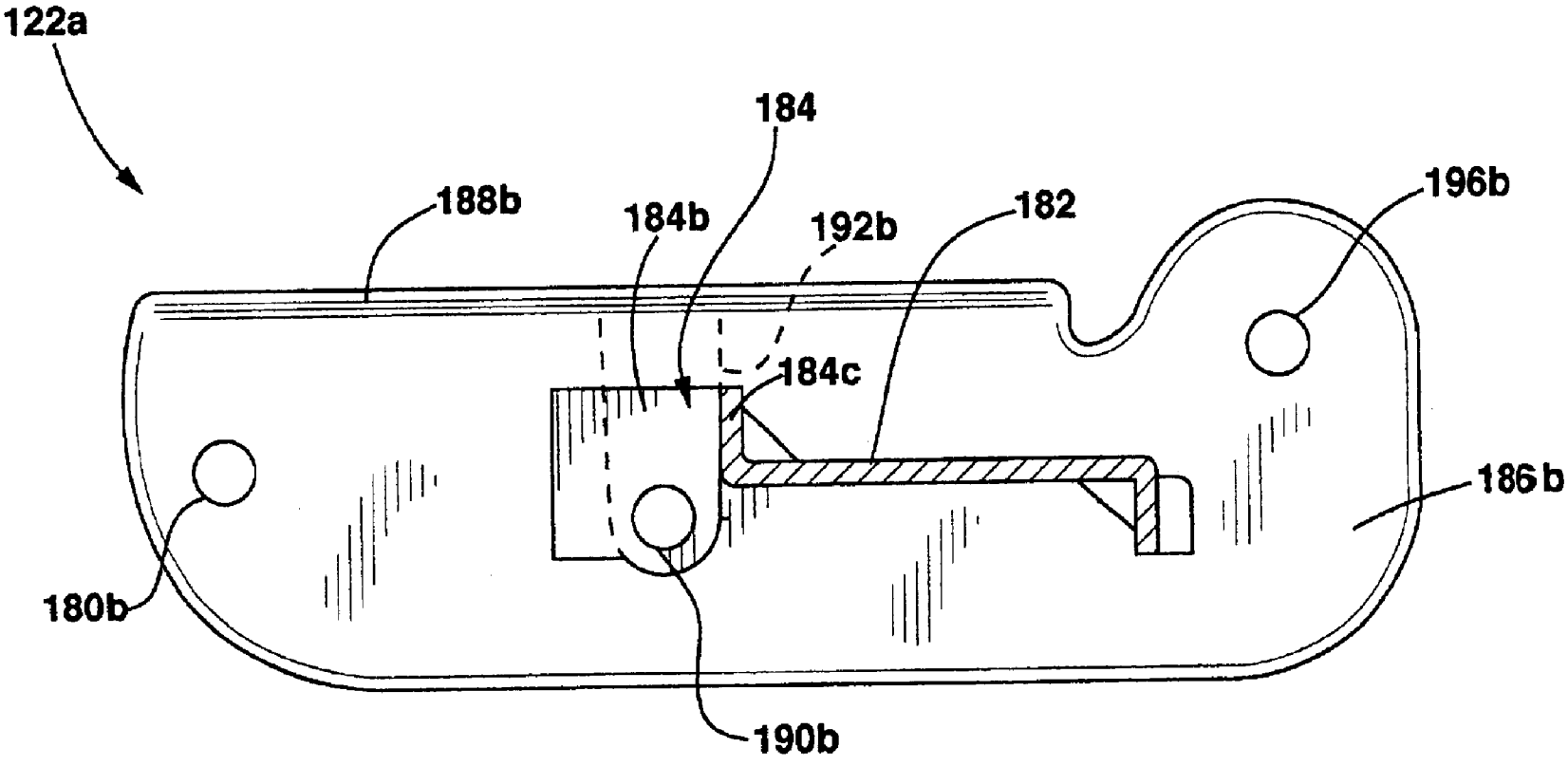
FIG. 19 is a cross section view of the latch along line 19—19 of FIG. 17.

FIG. 19 is a cross section view of the upper latch 122*a* along line 19—19 of FIG. 17 excluding latching post 104, operating handle 124, vertical post 110*a*, and pivot assemblies 126 and 128.

Figure 20:
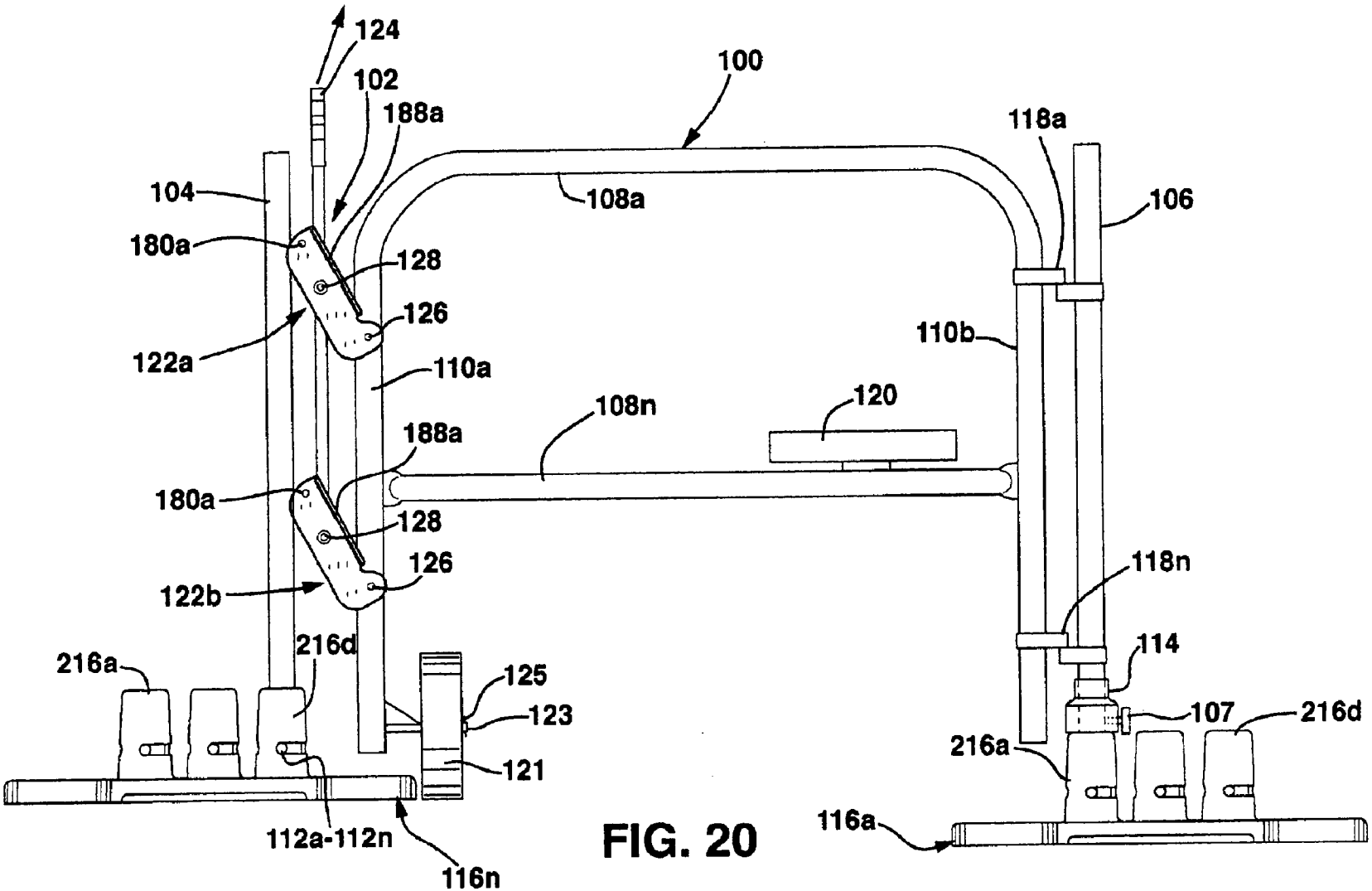
FIG. 20 is a view like FIG. 15 showing the mode of operation of the single pull double latching mechanism.

FIG. 20 shows the mode of operation of the single pull double latching mechanism 102 in the actuated position such as required prior to swinging of the gate section 100 about the hinges 118*a* and 118*n*. The operating handle 124 is actuated upwardly and slightly inwardly with respect to the structure of the gate section 100 to simultaneously operate the upper and lower latches 122*a* and 122*b* about their respective pivot assemblies 126 to disengage the upper and lower latches 122*a* and 122*b* from intimate captured contact with the latching post 104. Either of the upper and lower latches 122*a* and 122*b* may also be operated by any one of the manual operating tabs 188*a* or 188*b* whereby the operating handle 124 continues in the function as a linkage to operate the remaining untouched latch 122*a* or 122*b*. Such a function is useful should an individual be required to operate the single pull double latching mechanism from a position not convenient to the individual's position, such as a gate located in close proximity to the top of a stairs where the top of the operating handle could not be readily accessed.

Figure 21:
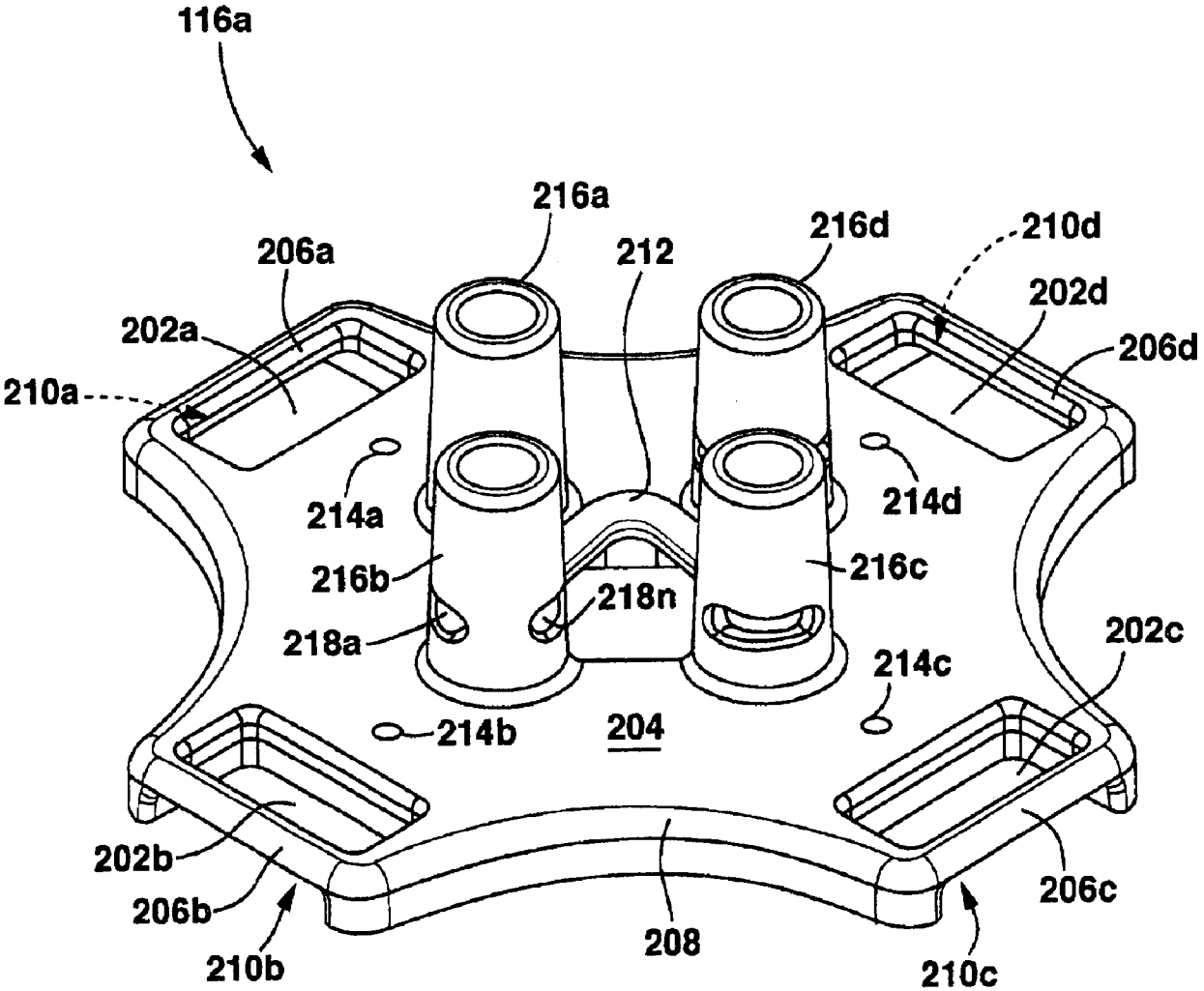
FIG. 21 is an isometric view of a base according to the present invention.
Figure 22:
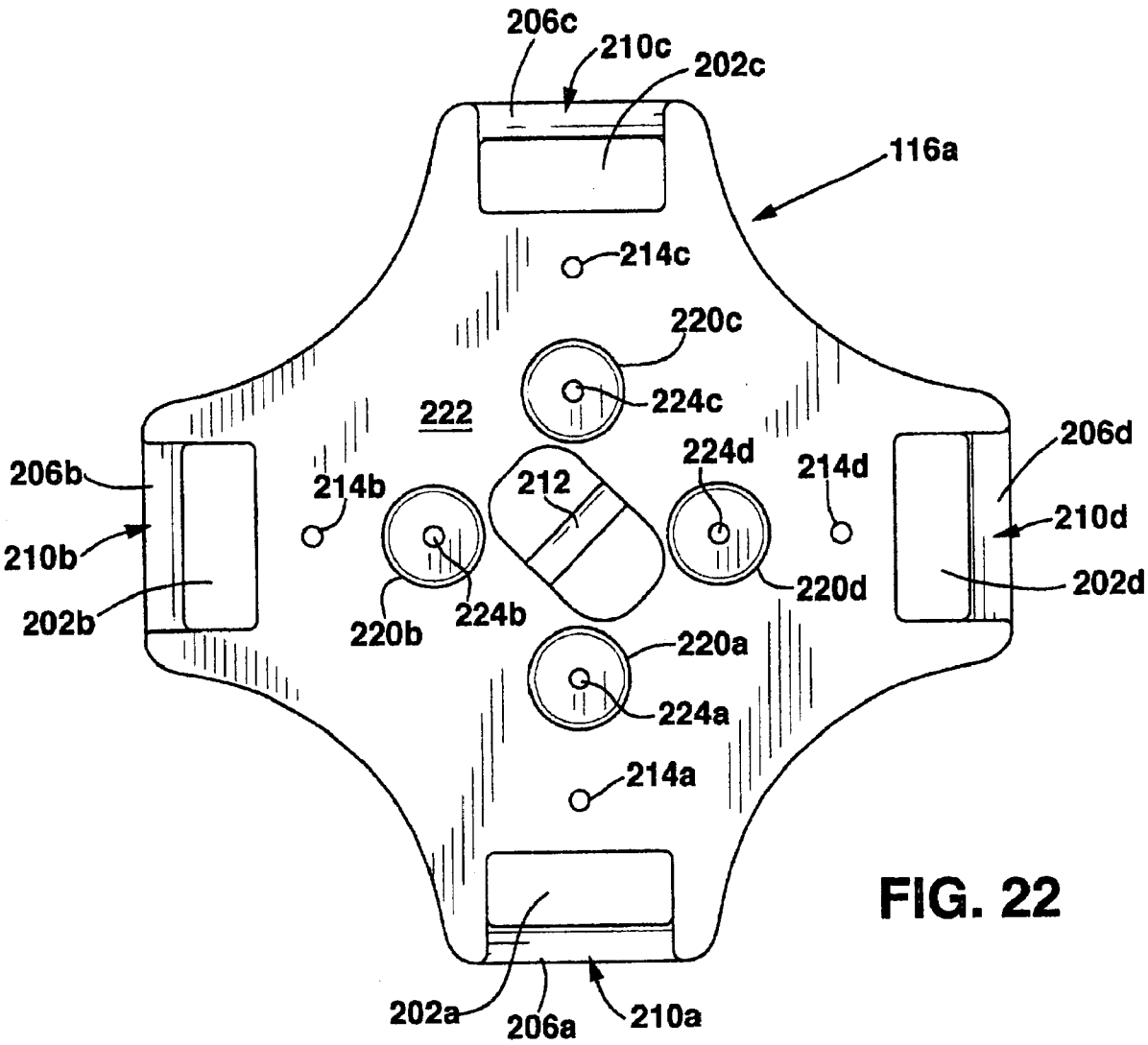
FIG. 22 is a bottom view of the base of the present invention.

FIG. 21 illustrates an isometric view of a base 116*a* according to the present invention, and FIG. 22 illustrates a bottom view of the base 116*a*. The bases 116*a*–116*n* include the attributes of the bases 14*a*–14*n* described previously and in addition include modified cutouts 202*a*–202*d*, which are restructured cutouts 40*a*–40*d*, whereby handling of the bases 116*a*–116*n* is readily facilitated in a manual fashion. Each base 116*a*–116*n* is constructed in the same manner having identical parts including a planar top portion or surface 204 with cutouts 202*a*–202*d* on four opposing sides creating built-in recessed handles 206*a*–206*d* for manual transporting or lifting of the bases 116*a*–116*n*. The bases 116*a*–116*n* are modified to include a continuous curved or radiused upper edge 208 about the planar top portion or surface 204. The recessed handles 206*a*–206*d* are fashioned to accommodate manual handling and include features making the gripping of the recessed handles 206*a*–206*d* accessible and comfortable. The upper and outer regions of the recessed handles 206*a*–206*d* are formed by portions of the curved or radiused upper edge 208, and the remaining edges forming the recessed handles 206*a*–206*d* have edges which are curved or radiused to eliminate any edges which could prove to be uncomfortable given the weight of the bases 116*a*–116*n*. It is to be appreciated that all of the upper edges of the cutouts 202*a*–202*d* are curved or radiused. Downwardly extending recesses 210*a*–210*d* beneath the recessed handles 206*a*–206*d* provide for manual access under the recessed handles 206 without first lifting the bases 116*a*–116*n*. There is also a centrally located lifting bar 212 which allows the user to hook the bases 116*a*–116*n* to a pulley or a dolly to more easily move the heavy bases 116*a*–116*n*. There are provided holes 214*a*–214*d* which can accommodate anchor bolts for securing the bases 116*a*–116*n* to a work surface such as a concrete floor or roof top if permanent mounting is desired. The bases 116*a*–116*n* include four post receivers 216*a*–216*d* which extend perpendicularly upward from planar top portion or surface 204 which can accommodate vertical posts 24*a*–24*b* of rail sections 12*a*–12*n*, latching posts 28*a*–28*n*, gate posts 34*a*–34*n*, latching posts 104, gate posts 106, locking couplers 54 and 114, or other suitably fashioned components. Each of these post receivers 216*a*–216*d* includes a plurality of horizontally aligned slots 218*a*–218*n*, best shown on post receiver 216*b*. Vertical posts 24*a*–24*b* of rail sections 12*a*–12*n*, latching posts 28*a*–28*n*, gate posts 34*a*–34*n*, latching posts 104, and gate posts 106 all incorporate a plurality of corresponding holes 48*a*–48*n* or 112*a*–112*n* for receiving locking pins 30 (FIG. 9) to hold the vertical posts 24*a*–24*b* of rail sections 12*a*–12*n*, latching posts 28*a*–28*n*, gate posts 34*a*–34*n*, latching posts 104, and gate posts 106 in place in the bases 116*a*–116*n* once the desired position is acquired. Once the vertical posts 24*a*–24*b* of rail sections 12*a*–12*n*, the latching posts 28*a*–28*n*, the gate posts 34*a*–34*n*, the latching posts 104 or the gate posts 106 are secured to bases 116*a*–116*n*, the slots will allow the vertical posts 24*a*–24*b* of the rail sections 12*a*–12*n*, the latching posts 28*a*–28*n*, the gate posts 34*a*–34*n*, the latching posts 104, or the gate posts 106 to pivot; however, the gate posts 34*a*–34*n* and the gate posts 106 preferably are locked against rotation by the locking couplers 54 or 114. Each base 116*a*–116*n* may accommodate a maximum of four of the following components in various combinations: vertical posts 24*a*–24*b* of the rail sections 12*a*–12*n*, latching posts 28*a*–28*n*, gate posts 34*a*–34*n*, latching posts 104, or gate posts 106. Each can be locked in any position within its range of motion. It is to be understood that the slots 218*a*–218*n* may be substituted with multiple holes at different heights, but holes will not allow the infinite 360 degree range at which the vertical posts 24*a*–24*b* of the rail sections 12*a*–12*n*, latching posts 28*a*–28*n*, gate posts 34*a*–34*n*, latching posts 104, and gate posts 106 may be locked. It is also to be understood that slots, such as slots 218*a*–218*n*, can be included at other levels along and about the post receivers 216*a*–216*d*, as well as at various locations about the circumference of the post receivers 216*a*–216*d* to maintain 360° positionable capabilities of any member which engages the interior of the post receivers 216*a*–216*d*.

FIG. 22 is a bottom view of the base 116*a*. Shown in particular are stacking recesses 220*a*–220*d* recessed into a planar bottom surface 222 which align with the post receivers 216*a*–216*d* extending from the planar top portion or surface 204 shown in FIG. 21. The stacking recesses 220*a*–220*d* are utilized for stacking or storage of bases 116*a*–116*n* when not in use. Also shown are drain holes 224*a*–224*d* extending through the bases 116*a*–116*n* and co-located between the post receivers 216*a*–216*d* and the stacking recesses 220*a*–220*d*.

Figure 23:
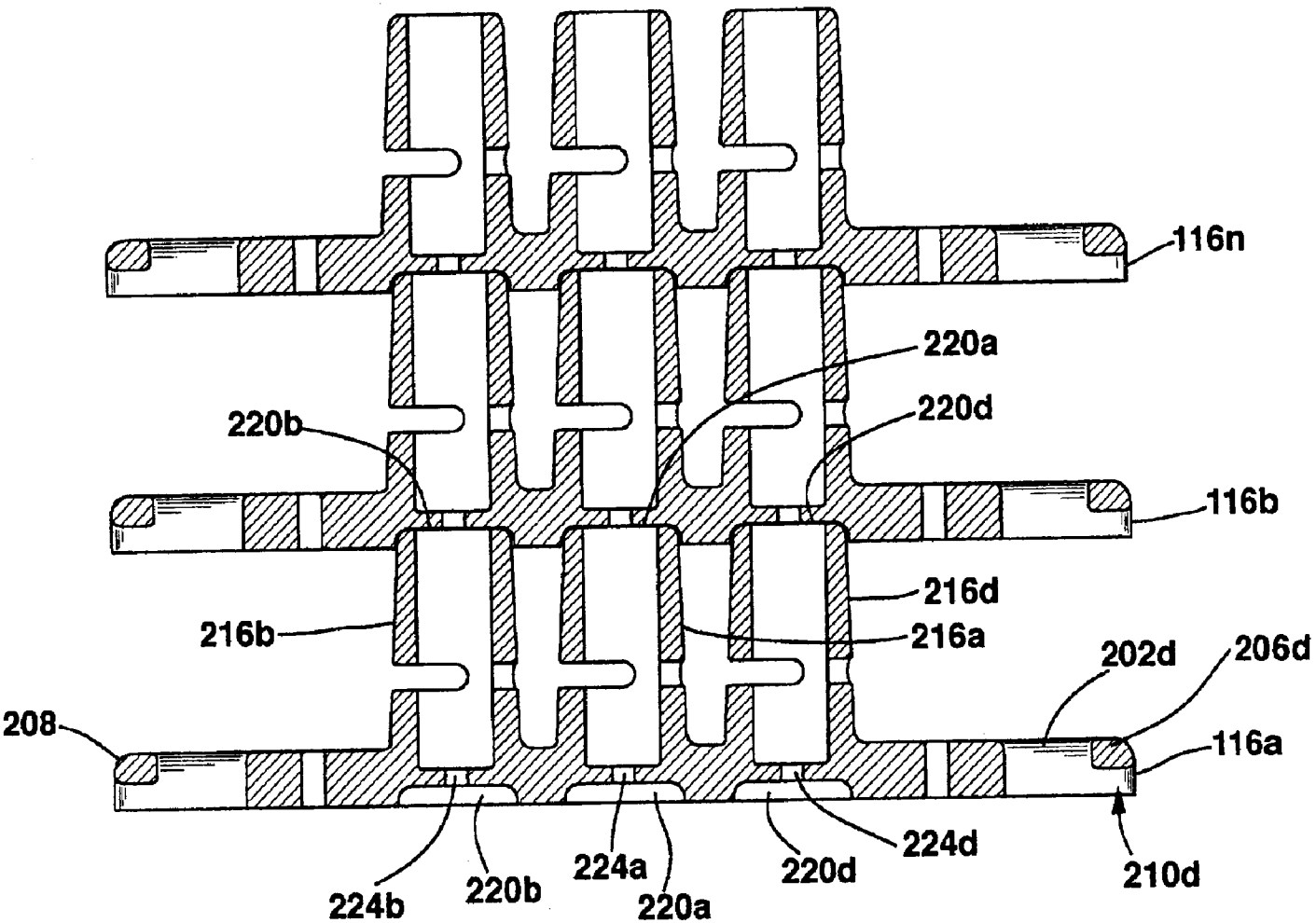
FIG. 23 shows the stacking of bases of the present invention when not in use.

FIG. 23 shows the stacking of bases 116*a*–116*n* when not in use. Shown in particular is the accommodation of each successively placed base by a lower base. The upper region of each post receiver 216*a*–216*d* (216*a*, 216*b* and 216*d* shown) of a lower or first base 116*a* accommodates the stacking recesses 220*a*–220*d* (220*a*, 220*b* and 220*d*, shown) of a second and higher base 116*b*. A third and yet higher base 116*n* is accommodated by the second base 116*b* in a similar fashion. Also shown at the right of the base 116*a* is the cross-sectional profile of the recessed handle 206*d* typical of recessed handles 206*a*–206*d* including the recess 210*d* thereunder.

Various modifications can be made to the present invention without departing from the apparent scope hereof.

It is claimed:

1. A gate section comprising:

a. a single pull double latching mechanism means which provides stability to the gate section, thus enabling the gate section to withstand the same type of forces which the rail sections can withstand; and, b. a single pull double latching mechanism means including two latches pivotally attached to the gate section which pivot toward the top of the gate section, each with its own manual operating tab and mutual operating handle, whereby both latches can be operated simultaneously.

2. The gate section of claim 1, including a support wheel for additional support of the gate during pivoted or static states.

3. A gate section for use in conjunction with and between a gate post and a latching post, the gate section comprising:

a. a first horizontal rail, the first horizontal rail having a first end and a second end;

b. a second horizontal rail spaced apart from the first horizontal rail, the second horizontal rail having a first end and a second end;

c. a first vertical post, the first vertical post connected to the first ends of the first and second horizontal rails;

d. a second vertical post, the second vertical post connected to the second ends of the first and second horizontal rails;

e. a pair of hinges, carried on first vertical post and upon the gate post, the hinges defining a two-point rotatable coupling between the gate post and the first vertical post; and, f. a single pull double latching mechanism secured on the second vertical post opposite the pair of hinges, with two pivotally attached latches on the second vertical post wherein said latches pivot toward the top and bottom of the gate section, the single pull double latching mechanism defining a two-point latch coupling between the second vertical post and the latching post.

4. The gate section of claim 3, further comprising a safety instruction container carried on the gate section.

5. The gate section of claim 4, wherein the safety instruction container is located upon the second horizontal rail.

6. The gate section of claim 3, further comprising a support wheel.

7. The gate section of claim 6, wherein the support wheel is attached to the second vertical post and provides additional support for the gate during static or pivotal states.

8. The gate section of claim 7, wherein the support wheel is attached to the second vertical post by a supported axle and a securing device.

9. The gate section of claim 8, wherein the securing device of the axle of the support wheel is a cotter pin.

10. The gate section of claim 3, wherein the single pull double latching mechanism includes:

a. an upper latch pivotally attached to the second vertical post;

b. a lower latch pivotally attached to the second vertical post and spaced below the upper latch;

c. an operating handle, the handle pivotally connecting central portions of the upper and lower latches and operating as a linkage therebetween.

11. The gate section of claim 10, wherein the operating handle of the single pull double latching mechanism extends above the upper latch.

12. The gate section of claim 10, wherein the upper and lower latch each includes an end opposite from pivotal attachment to the second vertical post, which ends have an open structure for capturing of the latch post within the open structure.

13. The gate section of claim 12, wherein upward actuation of the operating handle causes the upper latch and the lower latch to simultaneously pivot upward.

14. The gate section of claim 13, wherein simultaneous pivoting upward of the latches disengages the open structure of the latches from intimate captured contact with the latch post.

15. A system for controlling access between a latch post and a gate post, the system comprising a gate section having a pivotable hinged connection to the gate post and a single pull double latch mechanism for engaging the latch post, the single pull double latch including:

a. an upper latch pivotably moves in a vertical direction connected to the gate section;

b. a lower latch pivotably moves in a vertical direction and connected to the gate section;

c. a linkage member connected to mid-sections of the upper latch and the lower latch; and, d. open structures on the upper latch and the lower latch opposite the pivotable connect to the gate section, and wherein pivotably lifting one of the latches lifts the other latch such that the latch post may be simultaneously captured or released from both latches thereby restricting or allowing the gate section to pivot to allow access between and through the gate post and the latch post.

16. The system of claim 15, wherein the section includes a support wheel.

* * * * *